US005848331A

United States Patent [19]

Fromm

[11] Patent Number: 5,848,331

[45] Date of Patent: Dec. 8, 1998

[54] FUSER ROLL HOUSING

[75] Inventor: Paul M. Fromm, Rochester, N.Y.

[73] Assignee: Xerox Corporation, Stamford, Conn.

[21] Appl. No.: 838,630

[22] Filed: Apr. 11, 1997

[51] Int. Cl.[6] ..... G03G 15/20

[52] U.S. Cl. ..... 399/122; 399/110

[58] Field of Search ..... 399/110, 122; 219/216

[56] References Cited

U.S. PATENT DOCUMENTS

| | | | |
|---|---|---|---|
| 3,998,584 | 12/1976 | Wada et al. | 219/216 X |
| 4,428,660 | 1/1984 | Matsumoto | 399/122 |
| 4,589,758 | 5/1986 | Kasama et al. | 399/122 |
| 4,696,561 | 9/1987 | Katoh et al. | 399/122 |
| 4,717,937 | 1/1988 | Fukunaga | 399/122 |
| 5,191,380 | 3/1993 | Hoover et al. | 399/122 |

FOREIGN PATENT DOCUMENTS

| | | |
|---|---|---|
| 58-072179 | 4/1983 | Japan . |

*Primary Examiner*—Matthew S. Smith
*Attorney, Agent, or Firm*—Kevin R. Kepner

[57] ABSTRACT

A modular fuser assembly having a lightweight plastic structural housing. The lightweight housing is made possible by utilizing heavy steel endplates which are designed so that the net moment on each end plate pair is minimized. This is accomplished by having the load points on opposite sides of the endplate and aligned such that the moments tend to negate each other. The design of the endplates allows the use of relatively lightweight cross members thus enabling the lightweight thermoplastic housing.

4 Claims, 7 Drawing Sheets

FUSER ROLL HOUSING

This invention relates generally to a fusing system in an electrophotographic printing machine, and more particularly concerns an improved fuser roll housing for use in a modular fuser device.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Fuser frames in machines such as those described above, need to resist high load between the roll pair and some thrust load caused by imperfect alignment. The frame also is exposed to fairly high temperatures. Few fusers in existence use all plastic frames and these are generally thermoset plastics.

It is desirable that small steel end plates be designed such that the roll radial loads produce a net moment on the end plates of zero, and then mount these end plates into an all plastic housing. Utilizing the invention herein, the stress in the plastic housing can be kept low enough to use a thermoplastic. The advantages of using a plastic fuser housing are:

- increased thermal insulation of the fuser from the machine and user, lower power, safer CRU;
- reduction of fuser part count, many features molded in; lower cost;
- increased ability to eliminate typical wires and wire routing issues;
- lower weight.

The benefit of using a thermoplastic housing versus a thermoset include:

- greater ease of designing snap fit features;
- better tolerance control across the mold parting line (injection versus compression molding);
- reduced molding cycle time and no flash removal;
- much better recyclability of the used part.

In accordance with one aspect of the present invention, there is provided a modular fuser assembly comprising a cylindrical fusing member a cylindrical pressure member in contact with said cylindrical fusing member to form a nip therebetween, a pair of plate members located at each end of said cylindrical fuser and said cylindrical pressure member to maintain a spatial relation therebetween while aligning load forces to cancel torsional moments on said plates and a thermoplastic housing supporting said plate members and said fusing member and said pressure member.

Pursuant to another aspect of the present invention, there is provided an electrophotographic printing machine having a modular fuser assembly comprising a cylindrical fusing member a cylindrical pressure member in contact with said cylindrical fusing member to form a nip therebetween, a pair of plate members located at each end of said cylindrical fuser and said cylindrical pressure member to maintain a spatial relation therebetween while aligning load forces to cancel torsional moments on said plates and a thermoplastic housing supporting said plate members and said fusing member and said pressure member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
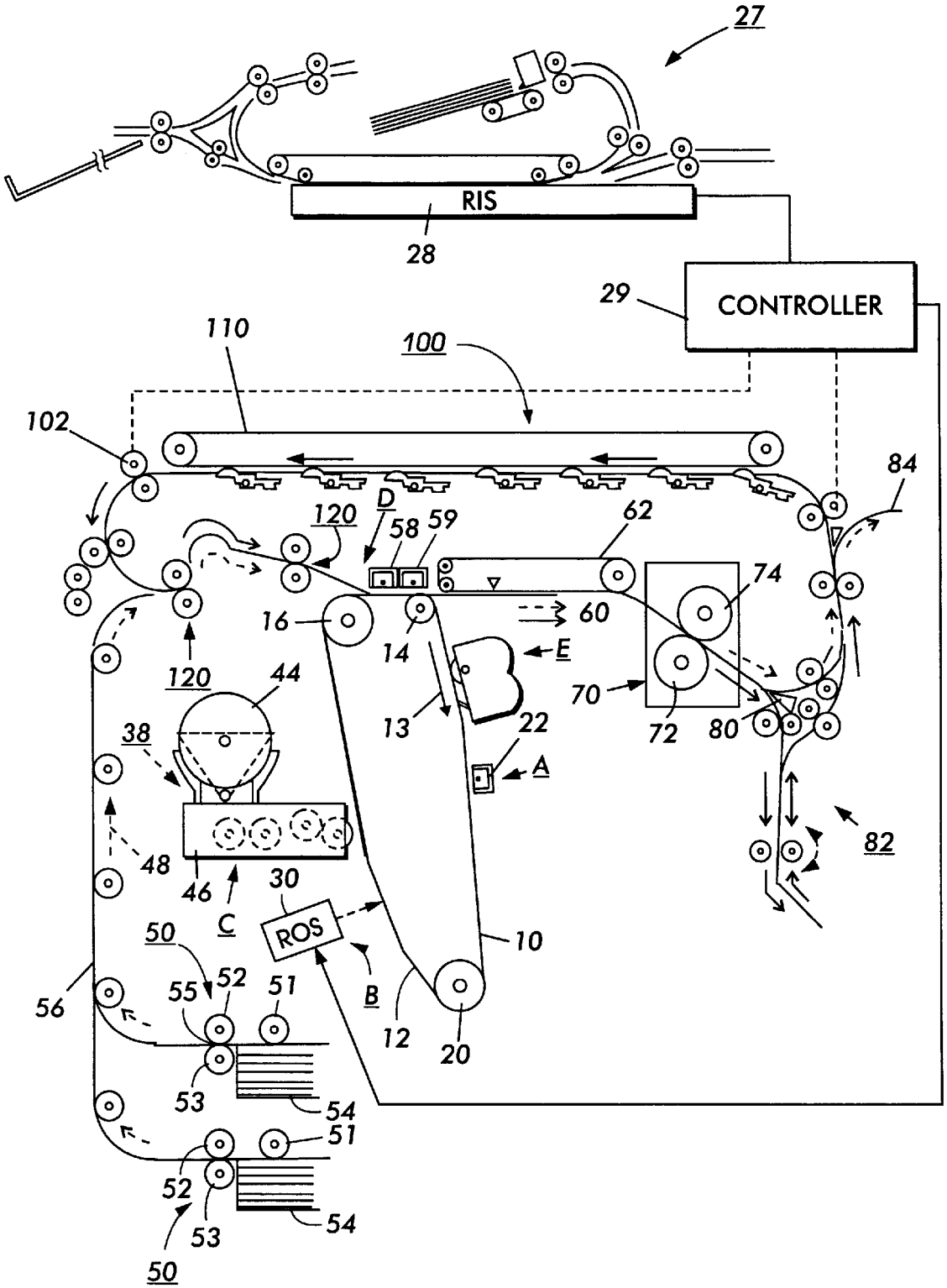
FIG. 1 is a schematic elevational view of a typical electrophotographic printing machine utilizing the fuser roll housing having metal sub frames in a large plastic fuser housing of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the fuser roll housing of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F of the invention herein, described in detail below.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is loaded against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72. Or alternatively, release agent is stored in a presoaked web (not shown) and applied to the fuser roll 72 by pressing the web against fuser roll 72 and advancing the web at a slow speed.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc . . . . The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
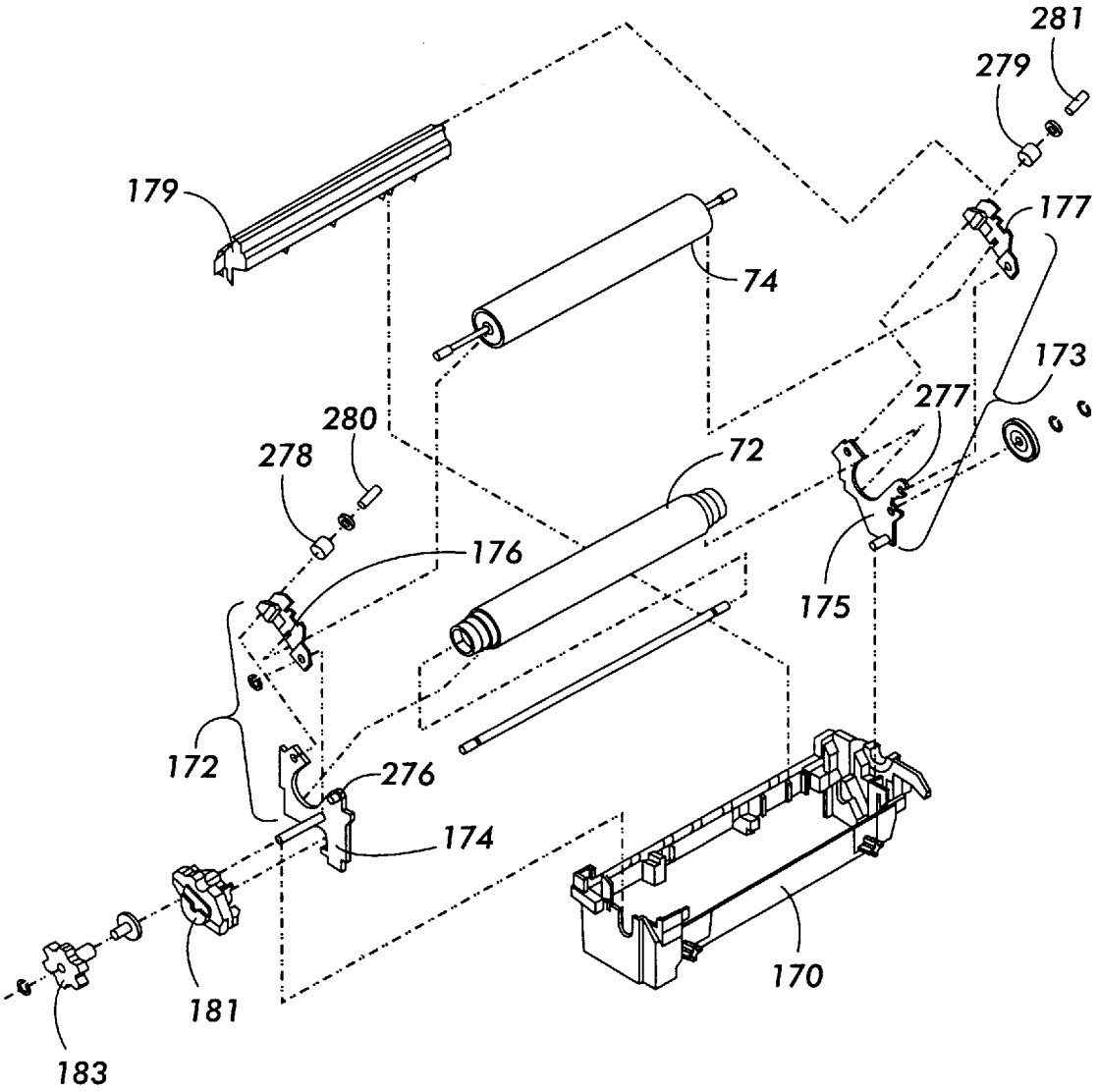
FIG. 2 is an exploded perspective view of the fuser module assembly including the end plates of the present invention.
Figure 3:
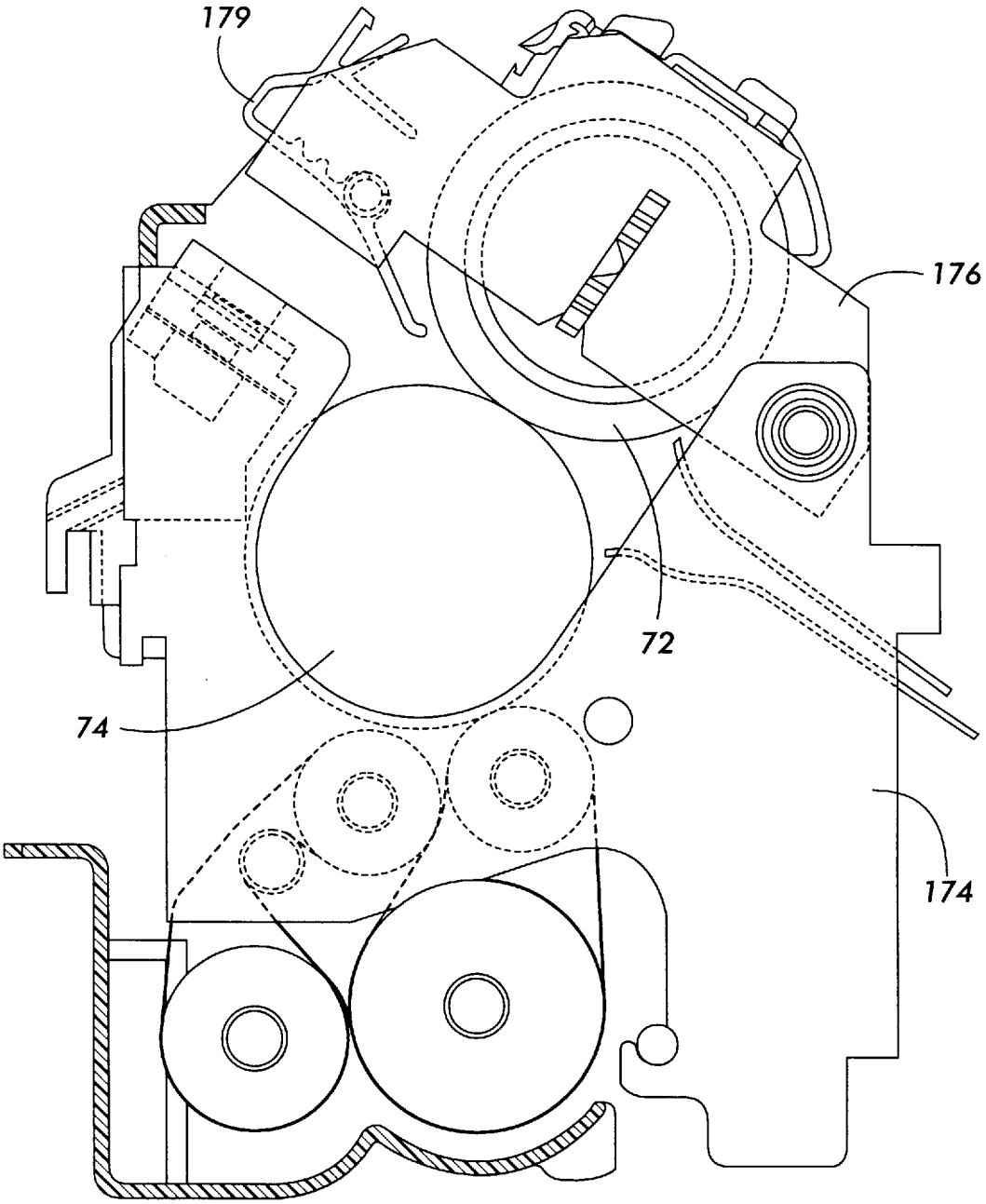
FIG. 3 is an end view of the FIG. 2 fuser module.
Figure 4:
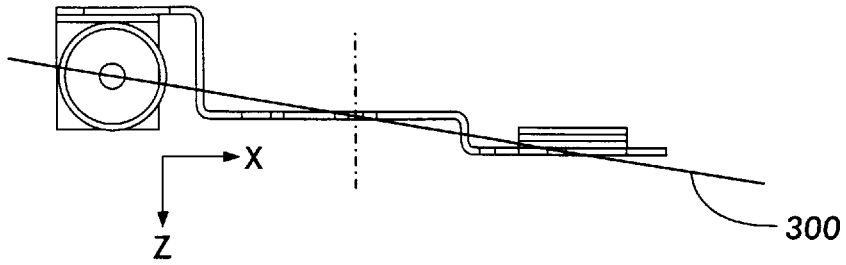
FIGS. 4, 5 and 6 are load diagrams illustrating the desired loads on the upper portion of the end plates.
Figure 5:
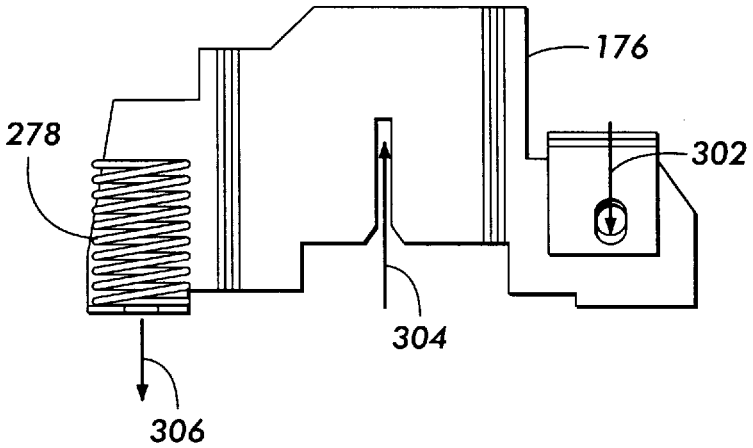
Figure 6:
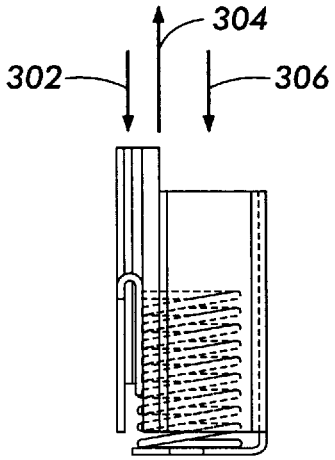
Figure 7:
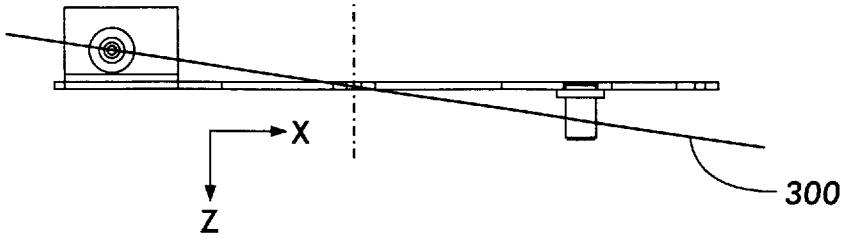
FIGS. 7, 8 and 9 are load diagrams illustrating the force distribution on the lower member of the end plates.
Figure 8:
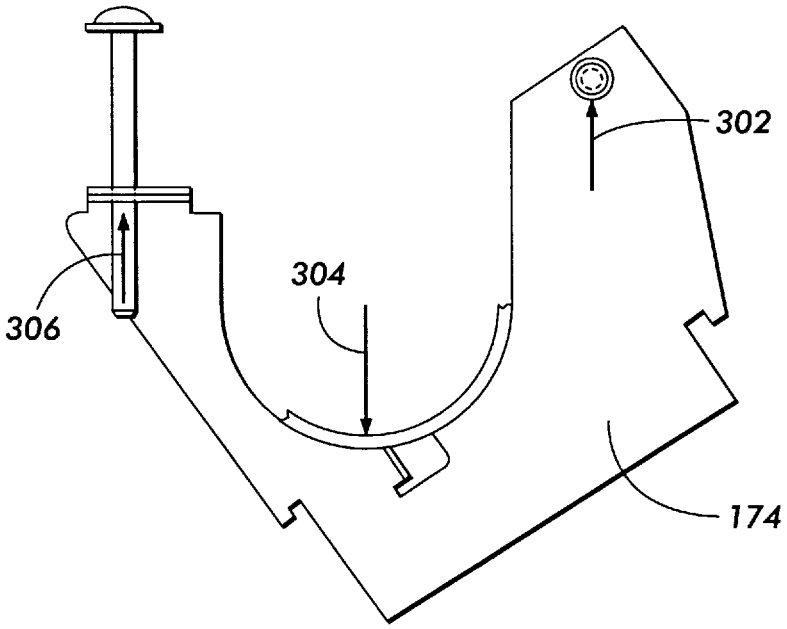
Figure 9:
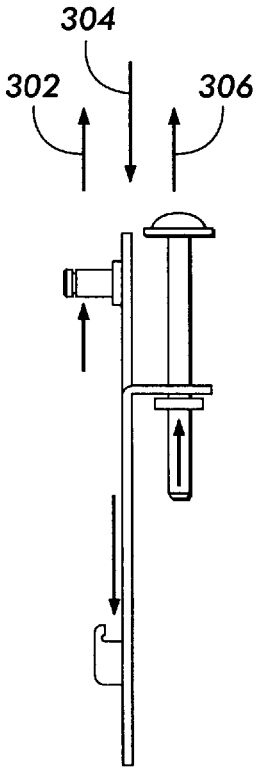
Figure 10:
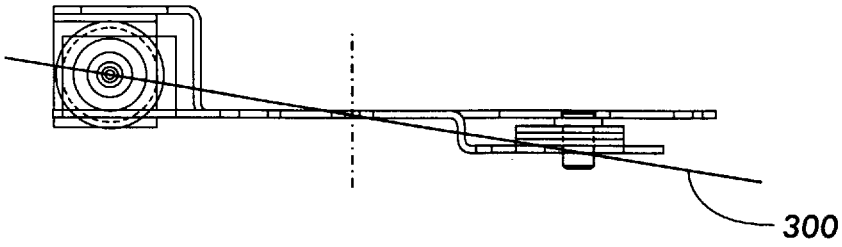
FIGS. 10 and 11 are composite load diagrams illustrating the forces on the entire end plate assembly.
Figure 11:
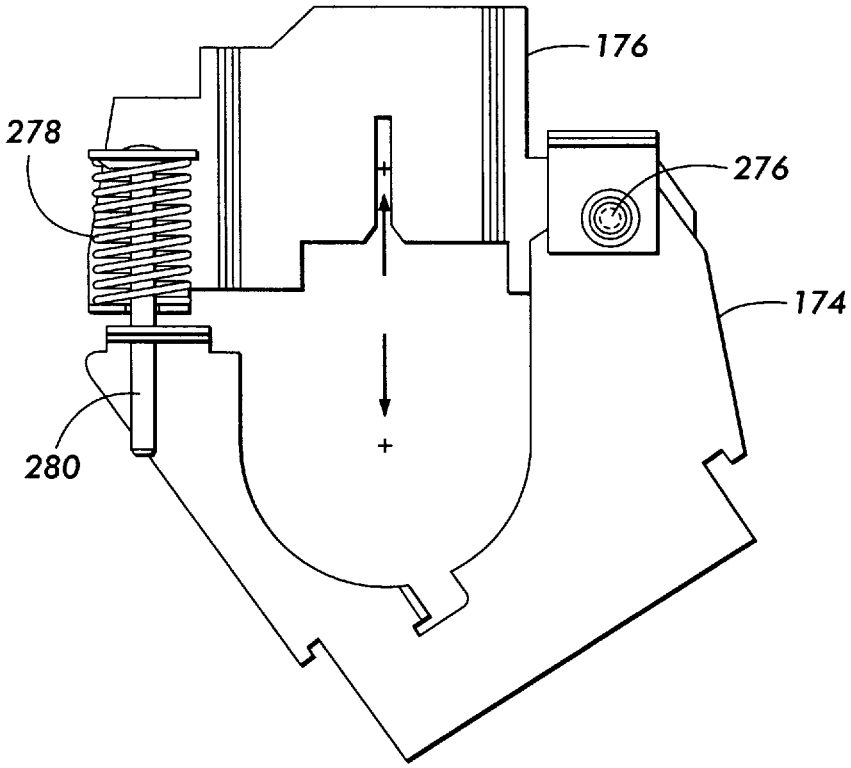

Turning next to FIGS. 2 and 3, an exploded view and an end view of the fuser module of the present invention. The fuser roll 72 and pressure roll 74 are mounted in the fuser housing 170 by steel end plates 172, 173. A sheet guide 179 directs a sheet having an unfused image thereon into the fusing nip. A mechanism 181 for clearing jams including handle 183 is connected to the fuser roll 72 to rotate the roll manually if necessary. Each end plate 172, 173 has a lower portion 174, 175 attached to an upper portion 176, 177 using a pivot pin 276, 277 and aperture at one end and a load spring 278, 279 and load screws 280, 281 at the opposite end.

Turning next to FIGS. 4 through 11 the solution to minimize the net twisting moment on the steel end plates which allows the light weight thermoplastic housing is to get all three loading vectors to fall on the same line. The vectors of interest are: the load arm pivot pin reaction 302, the fuser roll bearing, or pressure roll shaft reaction 304 and the load spring input force 306.

Referring still to FIGS. 4 through 11 in which load diagrams are illustrated for each of the components of the end plates 172, 173, the pivot pin should be on one side of the steel plate holding the fuser roll bearing or the pressure roll shaft and the load spring attachment should be on the opposite side. A straight line 300 should pass through all three points, the pivot pin, the load spring and the centerline of the frame contact with the fuser roll bearing or the pressure roll shaft. Thus, the vectors of all three points are colinear and on opposite sides of the plane of the endplate. The center vector also lies on the plane formed by the center of the axes of the pressure roll and the fuser roll. Thus, the distance parallel to the roll axis or "offset", from the centerline of the frame contact with the fuser roll bearing or the pressure roll shaft to the intersection of the load arm—pivot pin intersection or the load spring force application point is a function of the load arm mechanical advantage.

Configuring the plates in this manner minimizes the moment external to the plates pair required to hold them vertical but maximizes the moment trying to twist each plate. Thus the plates need to be beefed up compared to previous designs but the cross members between the plates are very lightly loaded. Likewise every effort should be taken to minimize the offset, and thus twisting moment, of the pivot pin and spring load application point while still maintaining a cost effective simple design. This minimizing effort must not violate the requirement of having the vectors all fall on the same line.

The cross members need to resist thrust forces. Based on measurements on a deliberately skewed fuser, the thrust is about 10% of the nip normal force. The cross members also need to keep the end plates aligned torsionally around the fuser roll centerline. There are virtually no other external forces acting to move the plates out of alignment, other than gravity or twisted mounting features thus the cross member can be a relatively inexpensive and light weight plastic housing. Input drive reaction torque should be resisted within one of the plates, such as passing the shaft of the driving gear through a hole in one of the plates. Otherwise, drive reaction forces may lift or twist one end relative to the other.

While the invention herein has been described in the context of a black and white printing machine, it will be readily apparent that the device can be utilized in any printing machine in which a fuser is used to bond toner images to a substrate.

In recapitulation, there is provided a modular fuser assembly having a lightweight plastic structural housing. The lightweight housing is made possible by utilizing heavy steel endplates which are designed so that the net moment on each end plate pair is minimized. This is accomplished by having the load points on opposite sides of the endplate and aligned such that the moments tend to negate each other. This design of the endplates allows the use of relatively lightweight and low strength cross members thus enabling the lightweight thermoplastic housing.

It is, therefore, apparent that there has been provided in accordance with the present invention, a fuser support assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A modular fuser assembly comprising:

a cylindrical fusing member;

a cylindrical pressure member in contact with said cylindrical fusing member to form a nip therebetween;

a pair of plate members located at each end of said cylindrical fuser member and said cylindrical pressure member to maintain a spatial relation therebetween while aligning load forces to cancel torsional moments on said plate members; and a thermoplastic housing supporting said plate members and said fusing member and said pressure member.

2. A modular fuser assembly according to claim 1, wherein said plate members comprise:

a first frame having a bearing support for one end of said fusing member or said pressure member;

a second frame having a bearing support for the corresponding end of said opposite of the aforementioned fusing member or said pressure member;

an attachment device to connect said first frame and said second frame at a first end;

a second attachment device to connect said first frame and said second frame at the first end, wherein said first attachment device and said second attachment device are located on the opposite planar surfaces of said plate members and are approximately colinear with the intersection of the plane of said plate members and the plane that contains both axes of said fusing and said pressure member, when viewed from the same intersection.

3. An electrophotographic printing machine having a modular fuser assembly, comprising:

a cylindrical fusing member;

a cylindrical pressure member in contact with said cylindrical fusing member to form a nip therebetween;

a pair of plate members located at each end of said cylindrical fuser member and said cylindrical pressure member to maintain a spatial relation therebetween while aligning load forces to cancel torsional moments on said plate members; and a thermoplastic housing supporting said plate members and said fusing member and said pressure member.

4. A printing machine according to claim 3, wherein said plate members comprise:

a first frame having a bearing support for one end of said fusing member or said pressure member;

a second frame having a bearing support for the corresponding end of said opposite of the aforementioned fusing member or said pressure member;

an attachment device to connect said first frame and said second frame at a first end;

a second attachment device to connect said first frame and said second frame at the first end, wherein said first attachment device and said second attachment device are located on the opposite planar surfaces of said plate members and are approximately colinear with the intersection of the plane of said plate members and the plane that contains both axes of said fusing and said pressure member, when viewed from the same intersection.

* * * * *